US008282389B2

(12) United States Patent
Dhulst et al.

(10) Patent No.: US 8,282,389 B2
(45) Date of Patent: Oct. 9, 2012

(54) MODULAR FLARE STACK AND METHOD OF FLARING WASTE GAS

(75) Inventors: Chris Dhulst, Beveren-Leie (BE); Geert Dumortier, Kortrijk (BE); Hans Van Der Pasch, Boxtel (NL)

(73) Assignee: NV Bekaert SA, Zwevegem (BE)

( * ) Notice: Subject to any disclaimer, the term of this patent is extended or adjusted under 35 U.S.C. 154(b) by 471 days.

(21) Appl. No.: 12/513,896

(22) PCT Filed: Oct. 31, 2007

(86) PCT No.: PCT/EP2007/061739

§ 371 (c)(1),
(2), (4) Date: May 7, 2009

(87) PCT Pub. No.: WO2008/055829

PCT Pub. Date: May 15, 2008

(65) Prior Publication Data

US 2009/0233248 A1 Sep. 17, 2009

(30) Foreign Application Priority Data

Nov. 8, 2006 (EP) ..... 06023216

(51) Int. Cl.
*F23G 7/08* (2006.01)

(52) U.S. Cl. ..... 431/5; 431/354; 431/355

(58) Field of Classification Search ..... 431/5, 202, 431/354, 355
See application file for complete search history.

(56) References Cited

U.S. PATENT DOCUMENTS

| | | | | | |
|---|---|---|---|---|---|
| 609,034 | A | * | 8/1898 | Mahler | 431/329 |
| 767,958 | A | * | 8/1904 | Rath | 431/355 |
| 1,294,504 | A | * | 2/1919 | Magee | 431/329 |
| 1,387,565 | A | * | 8/1921 | Thorp et al. | 431/355 |
| 1,405,100 | A | * | 1/1922 | Elmer et al. | 239/427.3 |

(Continued)

FOREIGN PATENT DOCUMENTS

EP 0 982 541 B1 1/2003

(Continued)

OTHER PUBLICATIONS

S. Heymans, "New proposal for the combustion of waste gas at your waste water treatment facility: Clean Enclosed Burner system CEB Modular for combustion of waste gas", *Bekaert CEB Technologies*, Jun. 19, 2006, (20 pages).

(Continued)

*Primary Examiner* — Kenneth Rinehart
*Assistant Examiner* — Jorge Pereiro
(74) *Attorney, Agent, or Firm* — Foley & Lardner LLP

(57) ABSTRACT

A modular flare stack used for the combustion of combustible fluids comprises: a gas feed pipe, at least two burner elements, and an automated control system for applying a fixed stoichiometric combustion to an air/gas venturi mixing system based on a feedback loop from the flue gas temperature. Mixing ratios are obtained either using a fan for gas flows at a lower pressure (less than 0.5 barg) or a venturi for gas flows at a higher pressure (more than 1 barg). The control system also determines the number of operational burner elements and which of the burner elements are to be operational. The flare stack provides premixed surface burners for waste gas streams, thus guaranteeing extremely low emissions and high destruction efficiency by complete combustion with a high turndown ratio.

14 Claims, 4 Drawing Sheets

U.S. PATENT DOCUMENTS

| | | | | |
|---|---|---|---|---|
| 3,705,784 | A * | 12/1972 | Reichhelm et al. | 431/116 |
| 3,816,059 | A * | 6/1974 | Straitz, III | 431/278 |
| 3,901,643 | A * | 8/1975 | Reed et al. | 431/202 |
| 3,932,111 | A * | 1/1976 | Liknes et al. | 431/202 |
| 3,990,838 | A * | 11/1976 | Jerde | 431/354 |
| 4,025,281 | A * | 5/1977 | Lapp | 431/5 |
| 4,038,032 | A | 7/1977 | Brewer et al. | |
| 4,105,394 | A * | 8/1978 | Reed et al. | 431/202 |
| 4,900,244 | A * | 2/1990 | Keller et al. | 431/5 |
| 4,942,772 | A * | 7/1990 | Welker | 73/863.83 |
| 5,302,113 | A * | 4/1994 | Eichelberger et al. | 431/155 |
| 5,429,496 | A * | 7/1995 | Stephens et al. | 431/202 |
| 5,496,171 | A * | 3/1996 | Ozawa et al. | 431/326 |
| 5,649,820 | A | 7/1997 | Keller et al. | |
| 6,067,790 | A * | 5/2000 | Choi et al. | 60/776 |
| 6,231,334 | B1 * | 5/2001 | Bussman et al. | 431/5 |
| 6,237,512 | B1 * | 5/2001 | Inoue | 110/346 |
| 6,568,933 | B1 * | 5/2003 | Guerra | 431/19 |
| 6,632,083 | B1 * | 10/2003 | Bussman et al. | 431/157 |
| 6,634,881 | B2 * | 10/2003 | Bussman et al. | 431/157 |
| 7,442,035 | B2 * | 10/2008 | Duesel et al. | 431/5 |
| 7,967,600 | B2 * | 6/2011 | Hong et al. | 431/202 |
| 2002/0058221 | A1 * | 5/2002 | Bussman et al. | 431/2 |
| 2005/0053887 | A1 * | 3/2005 | Westergaard | 431/354 |
| 2005/0074712 | A1 * | 4/2005 | Brookshire et al. | 431/202 |
| 2006/0240368 | A1 * | 10/2006 | Duesel et al. | 431/5 |
| 2006/0240369 | A1 * | 10/2006 | Duesel et al. | 431/5 |
| 2009/0029300 | A1 * | 1/2009 | Ponzi et al. | 431/12 |
| 2009/0053659 | A1 * | 2/2009 | Duesel et al. | 431/5 |

FOREIGN PATENT DOCUMENTS

| | | | |
|---|---|---|---|
| GB | 2 306 347 | A | 5/1997 |
| JP | 53-98530 | A | 8/1978 |
| NL | 1011009 | C2 | 7/2000 |
| WO | WO 93/18342 | A1 | 9/1993 |
| WO | WO 97/04152 | A1 | 2/1997 |
| WO | WO 2004/092647 | A1 | 10/2004 |
| WO | WO 2006/010693 | A1 | 2/2006 |

OTHER PUBLICATIONS

M. Apte, "Re: Clean Enclosed Burner system CEB 4500 for burning gas from gas plants", *Bekaert CEB Technologies*, Jun. 28, 2006, (21 pages).

* cited by examiner

MODULAR FLARE STACK AND METHOD OF FLARING WASTE GAS

FIELD OF THE INVENTION

The present invention relates to flare stacks and more in particular to ground flare stacks for flaring combustible fluids.

BACKGROUND

Flare stacks are widely used for combustion of combustible fluids such as waste gasses occurring at gas- or oil drilling sites, or liquids or process gasses at various chemical and petrochemical applications.

Most widely used flare stacks are of the open combustion type. Flare stacks combust fluids by means of a flame, where a burner assembly is mounted on top of a high stack. The combustion is done using open flames, possibly assisted by steam or compressed air for creating turbulent gas streams. An example is provided in U.S. Pat. No. 5,649,820. Such combustion may cause not only incomplete combustion, but also may cause thermal nuisance, noise and/or light pollution.

As an alternative, enclosed combustion may be used for flaring such waste or process fluids. As an example, NL1011009 describes such enclosed burner assembly for combustion of combustible gasses. Also JP53-98530 describes a flare stack using enclosed combustion of fluids. A more recent example flare stack is e.g. described in WO 2006/010693.

The presently known flare stacks are limited in capacity due to the specific build up of such a complete premix surface combustion chamber. Variations in flow and gas composition affect the air/gas ratio and can result in an instable combustion process generating smoke, odors and/or light.

In normal conditions, most flare or advance waste gas combustion systems have a turndown ratio (i.e. ratio of maximum to minimum firing rate on a modulating burner) of 5:1 to maximally 10:1. Higher turndown ratio's would allow the flare stack to handle a broad range of capacities.

The presently known flare stacks all require an operator to control the air excess for the premix, control safe operation and shutdown.

SUMMARY

An aspect of the present invention provides a flare stack which overcomes the disadvantages of the flare stack according to the presently known prior art.

A further aspect of the present invention provides a more complete combustion of combustible gasses such as e.g. waste gasses or liquids or process gasses from various chemical and petrochemical processes, waste gasses of oil or gas drilling or biogas.

In another aspect, the present invention provides a flare stack with complete combustion for a broad range of gas inputs.

Another aspect of the present invention provides an operator free system for keeping a complete combustion, thereby ensuring an efficient combustion with no or little light emissions, no odors or smoke and no noise and thus is less labor-intensive.

Another aspect of the present invention provides a flare stack which has an elevated turndown ratio. In a further aspect, the present invention provides a flare stack with a prolonged life-time.

Another aspect of the present invention provides a flare stack which has an easy maintenance, because of the modular character of the system and because of the ease of maintaining a defect burner element.

The above-mentioned advantageous effects are realized by a flare stack having the specific features described herein.

An aspect of the present invention provides a modular flare stack for enclosed flame combustion of combustible fluids. This flare stack is built up of at least two, burner elements and is supplied with a waste or process gas feed pipe. The gas feed pipe comprises detection for measuring the pressure of the waste or process gas. Each burner element is provided with a fully premixed air-combustible gas mixture and therefore equipped with means for obtaining such a fully premixed air-fuel mixture. The individual burner elements also have a gas inlet, a mixing chamber, a gas permeable combustion surface and a combustion chamber. The combustion chamber of each burner element is completely insulated individually with no connection to another burner element. The gas inlet is adapted to receive combustible fluids from said gas feed pipe. Each burner element also has a temperature detection measuring the temperature of the flue gasses. The flue gas temperature will then be used as a parameter for primary modulation of the combustion process, keeping the air excess ratio at a predetermined level. Preferably, the temperature detection is a thermocouple.

Each burner element therefore also has an air-excess modulation in said mixing chamber.

The modular flare stack further comprises a control responsive to the waste or process gas pressure detection and to the temperature detection, this control at a first level controlling the air-excess modulation of each burner element.

Preferably, the control of the modular flare stack also determines the number of operational burner elements.

More preferably, the control of the modular flare stack also determines which burner elements are operational. This makes it possible to wear out the different burner elements in a balanced way. When an additional burner element has to be ignited, the system will choose the burner element which is the youngest, i.e. the one that has the fewest burning hours. When a burner element is to be shut down, the system will choose the "eldest"/most worn burner.

Preferably, the means for obtaining the fully premixed air-fuel mixture in the modular flare stack is a venturi system. This venturi system is obtained by injecting combustible gas from the gas feed pipe via the gas inlet into a venturi at the beginning of the mixing chamber of the burner element. Such a venturi system is attached to the bottom side of the mixing chamber of each burner element.

When using this system, the air-excess modulation in the flare stack is a bleed (i.e. direct discharge of the combustible fluid) in the mixing chamber.

This configuration of the flare stack is typically used for high pressure gas flaring, such as for drilling and well testing operations or for loading/unloading or pressure relief applications.

In another preferred embodiment the means for obtaining the fully premixed air-fuel mixture in the modular flare stack is a fan system. The fan system blows air via a fan into the mixing chamber which is also supplied with combustible fluids from the gas feed pipe. When using this system, the air-excess modulation in the flare stack controls the speed of the fan.

The air-excess modulation for each burner element is controlled by a computer program which steers the ventilator speed or the bleed in function of the measured flue gas temperature, for each burner element in parallel. This will be explained further in FIG. 5.

This fully premixed air-fuel mixture is then guided via the mixing chamber to a first side of a gas permeable combustion surface and is combusted at the opposite side of the gas permeable combustion surface.

As an overstoichiometric mixture of combustible gas and air is present at the moment of combustion, a blue flame combustion of the combustible gas is obtained. As a result, no yellow flames occur, which directly results in minimal light emissions to the environment. And as less light is created by the combustion, the heat radiation by means of visible and infrared light is less.

This modular flare stack thus comprises an automated control system for fixed stoichiometric combustion applied to air/gas mixing system, based on feedback loop from flue gas temperature.

Using these premixed surface burner elements for waste gas streams, extremely low emissions and high destruction efficiency by complete combustion are guaranteed.

Mixing ratio's are obtained either using a fan for gas flows at lower pressure (less than 0.5 barg), either using a venturi for gas flows at higher pressure (more than 1 barg). But also other air-fuel mixing devices can be used.

The control system allows to obtain a fixed ratio air/gas, independent of the gas pressure, allowing for low emissions and high destruction efficiencies throughout the full modulation range of the burner.

In normal conditions, most flare or advance waste gas combustion systems have a turn-down ratio (i.e. ratio of maximum to minimum firing rate on a modulating burner) of 5:1 to maximally 10:1. Presently known systems have turn-down ratio's of 10:1.

By the cascade system of our invention, our system can be operated with much higher turn-down ratio's, e.g. 40:1, 60:1, 80:1, 100:1, 150:1, 200:1, 240:1.

Preferably the flare stack of the invention comprises at least two burner element, such as two, three, four, five, six, seven, eight, nine, ten, fifteen, twenty, twenty-four or even more burner elements.

The gas permeable combustion surface may be provided in many different ways. It is of importance that the combustion surface comprises apertures for allowing combustible gas through the surface, which apertures are small enough to prevent the combustible gas to inflame at the gas-side of the combustion surface.

Alternatively a metal fiber burner membrane may be used, as e.g. a woven or knitted metal fiber membrane from WO 97/04152 or WO 2004/092647 or a sintered and perforated metal fiber membrane from WO 93/18342 or a needled metal fiber membrane from EP982541.

It is understood that the gas permeable combustion surfaces may have many different cross sectional shapes such as round, oval, square or rectangular.

The gas permeable combustion surface is preferably made of a temperature resistant stainless steel alloy such as Aluchrome®- or Fecralloy®-alloys.

The dimensions of the flare stack of the invention compared to the existing flare stacks are significantly reduced for combustion of comparable amounts of gas.

A further advantage of the control determining which burner elements are operational, is the ease of maintenance of the system. The system will indicate automatically when a combustion surface needs to be replaced. Each burner element having an individual insulation can be maintained in a fairly easy way. The insulated stack is vertically movable via a sliding system, making an easy replacing of the gas permeable combustion surface possible. Because the vertical displacement of the insulated stack guarantees a leak tight sealing of the burner element when remounting the stack on the combustion surface, there is no gas or heat leakage. This vertical displacement of the stack also secures the system against damage of the insulation when demounting, because of no relative movement between the immovable and the movable parts.

It is further understood that the flare stack of the invention may additionally comprise other elements such as means for ignition of the combustible gas, pilot flames, means for flame monitoring, means for flash back monitoring, and many more.

It is further understood that above described flare stack is suitable for flaring rich gases having a high heating value. To make the system suitable to also flare lean gasses having a low heating value, a combustible gas of high heating value employed as an assist gas can be used in the ways already known in the art, which will not be described herein any further. Furthermore, the above described flare stack is suitable to flare lean gases without the use of any assist gas, as long as the upper heating value is 6 $MJ/Nm^3$ or higher.

Further advantages and embodiments of the present invention will become apparent from the following description and drawings.

BRIEF DESCRIPTION OF THE DRAWINGS

Example embodiments of a modular flare stack of the invention are described in more detail with reference to the accompanying drawings in which.

REFERENCE LIST OF USED NUMBERS IN THE FIGURES

Figure 1:
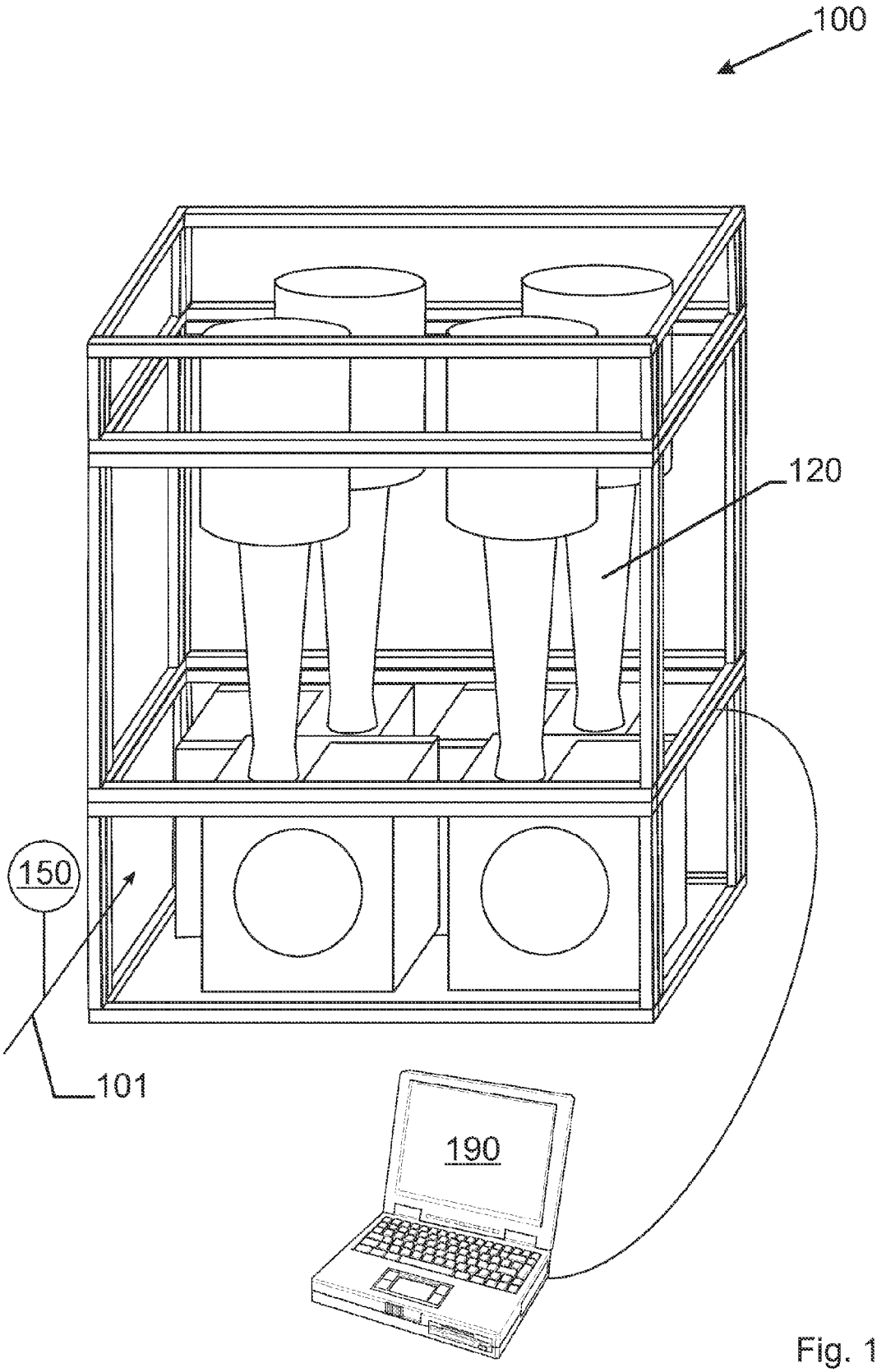
FIG. 1 is a schematic side view of an example embodiment of a flare stack of the invention.

100 modular flare stack
101 gas feed pipe/supply conduit
120 burner element
121 gas inlet
122 system for obtaining a fully premixed air-fuel mixture
123 gas permeable combustion surface
124 mixing chamber
125 combustion chamber
126 top of combustion chamber open to the environment
130 fan
131 bleed
132 venturi
140 flue gas temperature detection
141 premix gas temperature detection
150 waste or process gas pressure detection in supply conduit

190 a control responsive to flow detection 150 and to temperature detection 140 for controlling the delivery of additive gaseous material (air/waste or process gas) and for coordination of the operation of the burner elements

200 vertically movable insulated stack

210 sliding system

DESCRIPTION

The flare stack of the invention is built up of at least one, but preferably more than one, burner element and is supplied with a waste or process gas feed pipe.

FIG. 1 shows an example of such a modular flare stack with 4 burner elements.

A flare stack 100 comprises a number of identical burner elements 120 and a gas feed pipe 101. The gas feed pipe 101 comprises a detection 150 for measuring the pressure of the waste or process gas.

Figure 2:
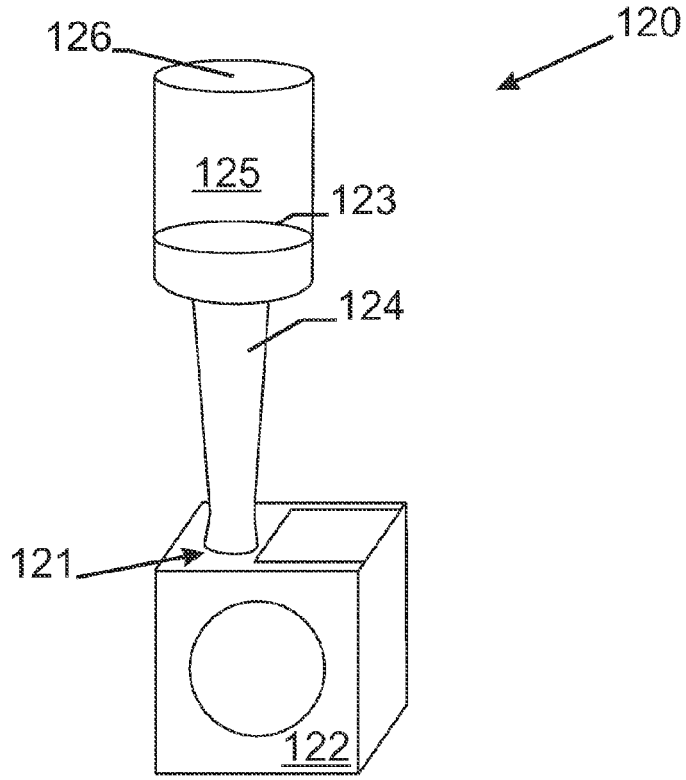
FIG. 2 is a schematic side view of one burner element in a flare stack according to the invention.

FIG. 2 is a detail of one burner element as used in the present invention, e.g. four of these burner elements are used in FIG. 1.

The burner element 120 has a gas inlet 121, a mixing chamber 124, a gas permeable combustion surface 123 and a combustion chamber 125. The burner element 120 has a system 122 for obtaining a fully premixed air-fuel mixture, which is provided with the combustible gas via the gas inlet 121. The air and gas are led into the mixing chamber 124. The fully premixed air-gas mixture obtained in the mixing chamber 124 is led to the combustion chamber 125 through a gas permeable combustion surface 123. This mixture is ignited and combusted at the combustion surface 123, providing a blue flame front. This complete combustion guarantees extremely low emissions and high destruction efficiency.

The exhaust gas provided by the combustion is evacuated via the open area 126.

The combustion chamber 125 of each burner element 120 is completely insulated individually with no connection to another burner element.

The gas inlet 121 is adapted to receive combustible fluids from the gas feed pipe 101.

Each burner element 120 also has a temperature detection 140 measuring the temperature of the flue gasses. The flue gas temperature will then be used as a parameter for primary modulation of the combustion process, keeping the air excess ratio at a predetermined level, which will be explained further by FIG. 5.

Preferably, the temperature detection 140 is a thermocouple.

Each burner element also has a system for air-excess modulation in said mixing chamber 124.

The complete modular flare stack 100 of FIG. 1 further comprises a control 190 responsive to the waste or process gas pressure detection 150 and to the temperature detection 140, this control 190 in a first level controlling the air-excess modulation of each burner element 120. Preferably, the control 190 of the modular flare stack also determines the number of operational burner elements.

More preferably, the control 190 of the modular flare stack also determines which burner elements are operational. This makes it possible to wear out the different burner elements in a balanced way. When an additional burner element has to be ignited, the system will choose the burner element which is the youngest, i.e. the one that has the fewest burning hours. When a burner element is to be shut down, the system will choose the "eldest"/most worn burner.

Figure 3:
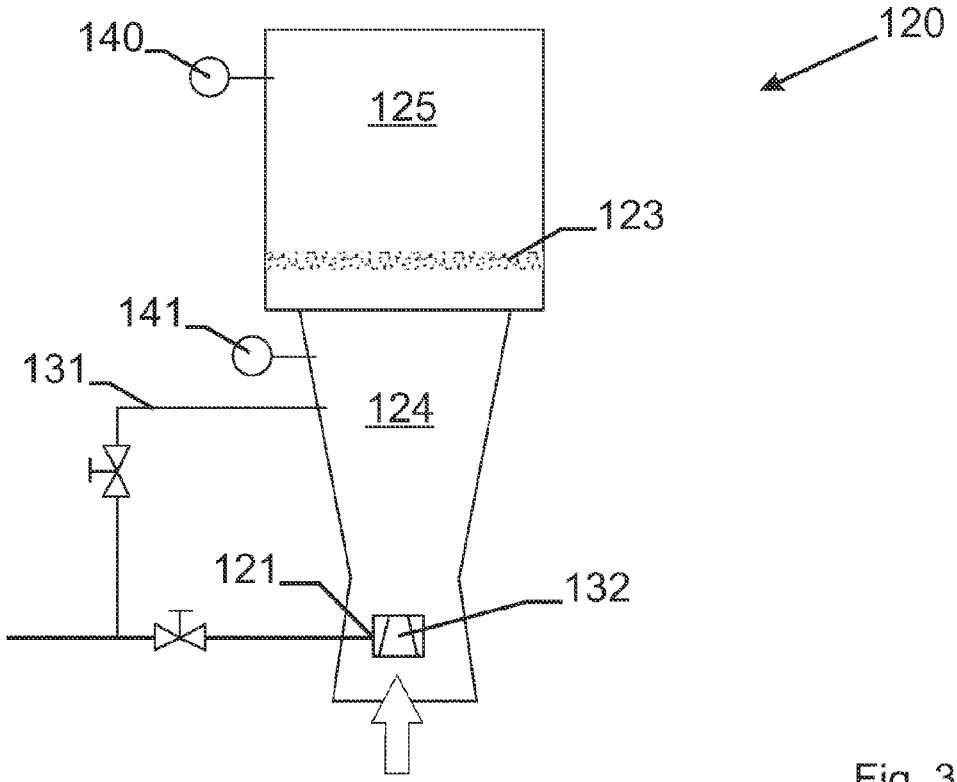
FIG. 3 is a schematic view of an example embodiment of a burner element in a flare stack according to one aspect of the invention.

FIG. 3 shows schematically one preferred embodiment of a burner element 120. The system 122 used in this embodiment, for obtaining the fully premixed air-fuel mixture in the modular flare stack 100 is a venturi system 132. This venturi system 132 is obtained by injecting combustible gas from the gas feed pipe 101 via the gas inlet 121, into a venturi at the beginning of the mixing chamber of the burner element 120. Such a venturi system 132 is attached to the bottom side of the mixing chamber 124 of each burner element 120.

When using this system, the air-excess modulation of each burner element 120 steers a bleed 131 (i.e. direct discharge of combustible gas) in the mixing chamber 124.

This configuration of the flare stack is typically used for high pressure gas flaring, such as for drilling and well testing operations or for loading/unloading or pressure relief applications.

Figure 4:
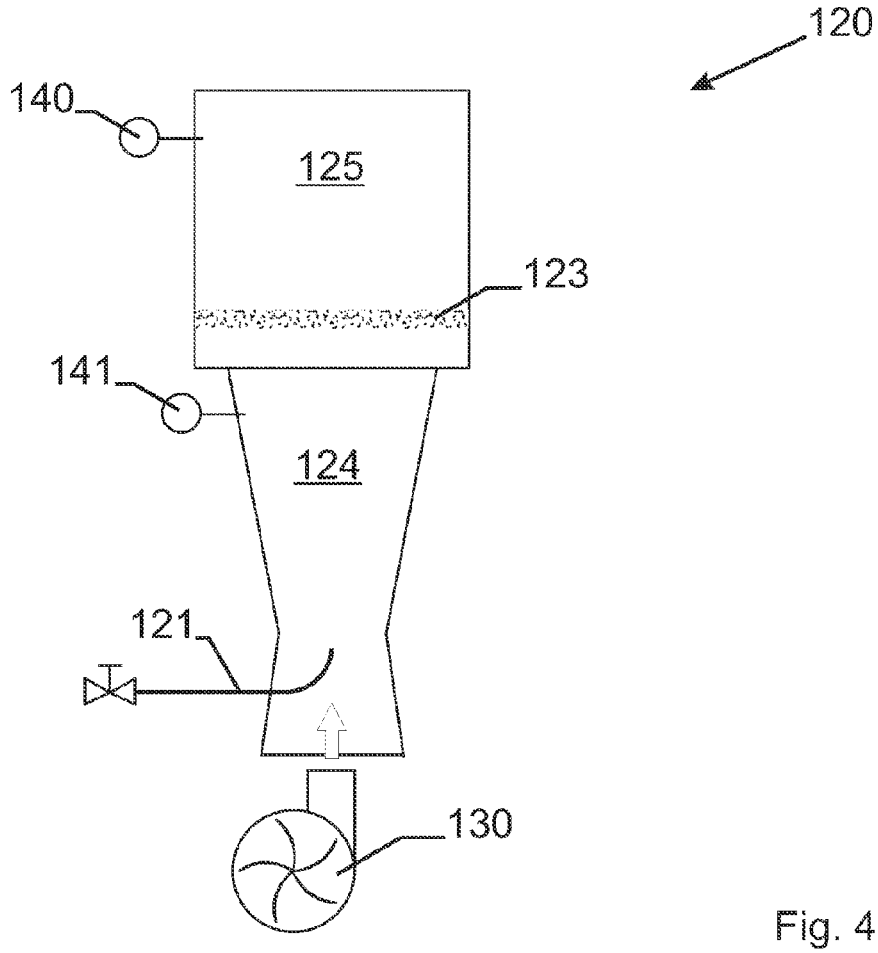
FIG. 4 is a schematic view of an example embodiment of a burner element in a flare stack according to an alternative aspect of the invention.

In another preferred embodiment, as shown in FIG. 4, the means 122 for obtaining the fully premixed air-fuel mixture in the modular flare stack is a fan system 130. The fan system blows air via a fan into the mixing chamber which is also supplied with combustible gases from the gas feed pipe 101. When using this type of system, the air-excess modulation in the flare stack controls the speed of the fan.

Figure 5:
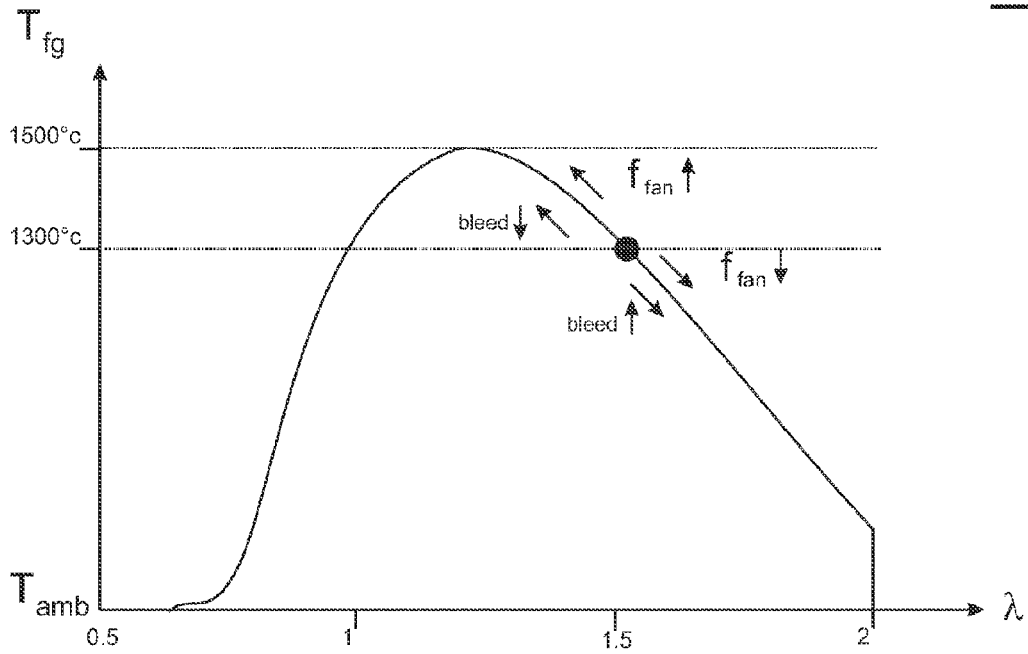
FIG. 5 is a graph showing the working principle of the first modulation in one aspect of the invention.

The air-excess modulation for each burner element is controlled by a computer program which steers the ventilator speed or the bleed in function of the measured flue gas temperature, for each burner element in parallel, following the principle as explained in FIG. 5.

The control system allows to obtain a fixed ratio air/gas, independent of the gas pressure, allowing for low emissions and high destruction efficiencies throughout the full modulation range of the burner.

In the systems of FIGS. 1 to 4, the gas permeable combustion surface is made of a NIT® burner.

The control 190, steering the optimal working of the flare stack 100, provides a two level cascade regulation.

In a first level, the control 190 steers the air-excess modulation. This principle is explained in FIG. 5. The control system keeps the air-excess ratio ($\lambda$) constant at 1.3. This gives a temperature of the flue gasses of 1300° C. The combustion temperature used as the primary parameter for excess air regulation is variable and depends on the type and composition of the waste gas stream. Therefore, although in this text a temperature of 1300° C. is used, this temperature can vary between 1000° C. and 1400° C.

In the venturi burner system, when temperatures become lower than 1300° C., the control system 190 will give more bleed, giving more combustible gas for the same amount of air, thus lowering the air-excess ratio. This increases the flame temperature, and consequently also the temperature of the flue gasses. When temperatures get higher than 1300° C., bleed is reduced. The reduced bleed gives a higher air-excess ratio ($\lambda$), resulting finally in a lower temperature of the flue gasses.

In the fan burner system, when the temperature of the flue gasses rise, the fan is speeded up, resulting in a higher $\lambda$ and lower flue gas temperatures. When the temperature of the flue gasses gets lower than 1300° C., the fan is slow down, resulting in lower $\lambda$ and higher flue gas temperatures.

When the capacity of a burner element gets lower than 40% or higher than 90% the control system acts on a second level. In the second level the control system provides a cascade.

The cascade regulation is based on the principle that in function of operation conditions, a number of burners will be switched on or off. Taking a total amount of n burners, whenever the operational capacity of the number of burners in operation (take x burners) is reaching above 90% of their total capacity, an additional burner is switched on, until the maximum number n is reached.

On the other hand, if capacity detected of the x burners is reaching below 40%, burner x is turned off, and x−1 burners are left operating, until only one burner is operating.

This regulation is in use constantly, determining how many burners are operating, and keeping combustion performance in ideal conditions throughout the full modulation range of the process.

In order to allow for smooth start-up, the cascade regulation only is effective, after successful startup has been proved. Startup conditions (number of burners) are determined in an independent way, in order to adapt the settings to the existing process conditions.

The detection of the % of capacity mentioned above can be done in different ways, depending on the combustion air technology chosen:

in case of combustion air fans, used with PID controlled speed modulation, the feedback of the frequency output of the variable frequency drive is directly used as input to the % of capacity. There is a direct linear relation between combustion fan speed and % capacity of a burner system with CEB® technology.

in case of high-pressure venturi system for combustion air supply, the feedback of the pressure on the main process line, can be used for % capacity determination. The pressure upstream of the CEB® system is a direct measure of the % capacity going through the burner system, just as the combustion air fan frequency mentioned above.

A further embodiment of a flare stack according to our invention is described with reference to FIGS. 6*a* and 6*b*.

Figure 6A:
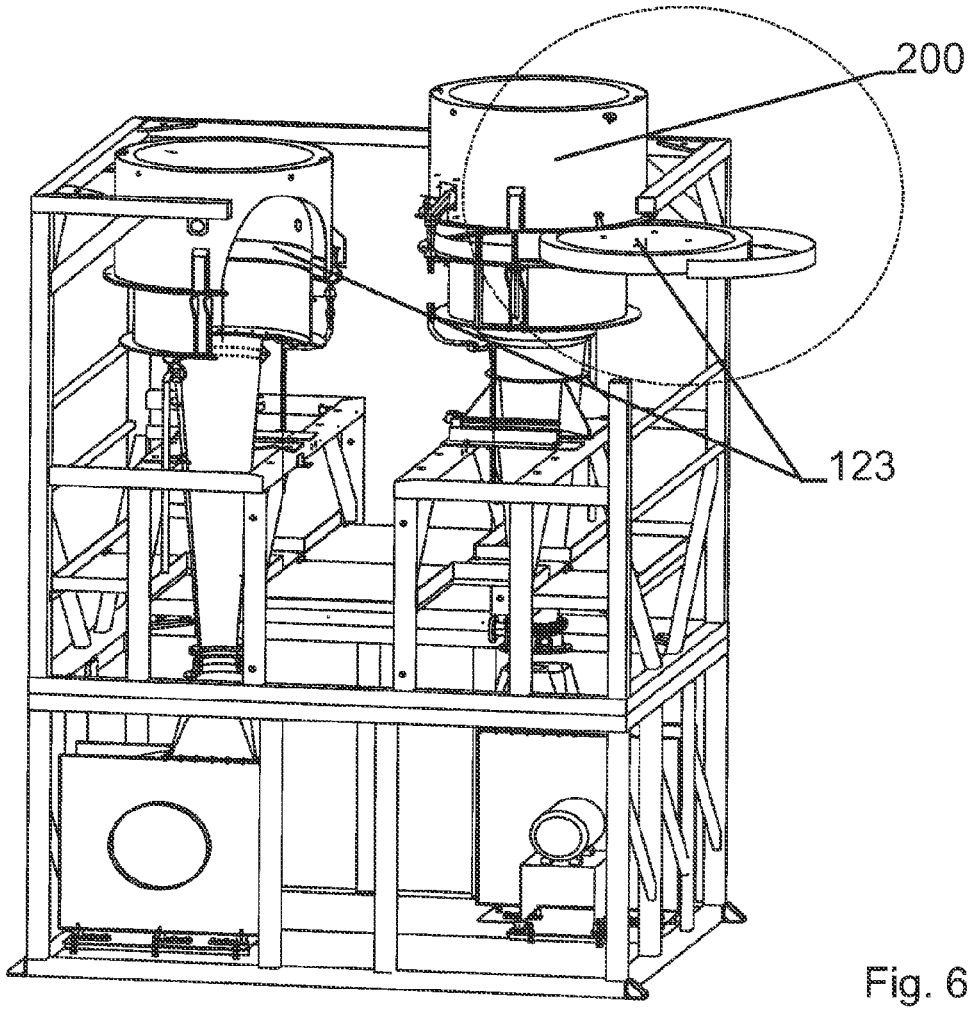
FIG. 6A is a schematic 3D-view of an embodiment of the flare stack of the invention.
Figure 6B:
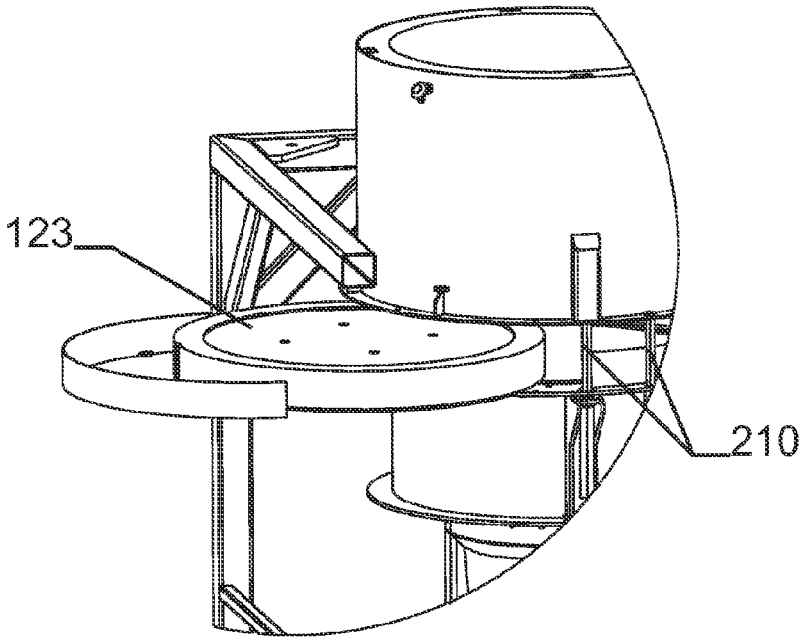
FIG. 6B is a close up of FIG. 6A.

The flare stack in FIG. 6A contains two burner elements 120. Each burner element 120 comprises a vertically movable insulated stack 200. The sliding systems 210 allow the insulated stack to be moved vertically, without any horizontal displacement. The guarantees that the insulation will not get damaged by opening the system and makes the closing of the system a simple operation guaranteeing the insulation being placed back upon the removable gas permeable combustion surface 123 in a leak tight way, i.e. there is no gas nor heat leakage.

The modular flare stack for combustion of combustible fluids of our invention comprises a gas feed pipe and at least one burner element for combustion of the combustible fluids.

This modular flare stack comprises an automated control system for fixed stoichiometric combustion, based on feedback loop from flue gas temperatures. Mixing ratio's are obtained either using a fan for gas flows at lower pressure (less than 0.5 barg), either using a venturi for gas flows at higher pressure (more than 1 barg).

The control system also determines the number of operational burner elements and which burner elements are operational.

The flare stack of the invention provides premixed surface burners for waste gas streams, guaranteeing extremely low emissions and high destruction efficiency by complete combustion with a high turndown ratio.

The invention claimed is:

1. A modular flare stack for enclosed flame combustion of a combustible fluid, comprising:

a gas feed pipe having a gas pressure detector configured to measure gas pressure;

at least two burner elements configured to combust the combustible fluid, wherein each of the at least two burner elements is equipped with a system configured to obtain a fully premixed air-fuel mixture; and a controller, wherein each of the at least two burner elements comprises:

a gas inlet configured to receive the combustible fluid from the gas feed pipe, a replaceable gas permeable combustion surface, a mixing chamber, a combustion chamber, a temperature detector configured to measure a flue gas temperature, an air-excess modulator connected to the mixing chamber, and a vertically movable insulated stack, wherein the controller is configured to be responsive to the gas pressure detector, to be responsive to the temperature detectors, and to control the air-excess modulators.

2. A modular flare stack according to claim 1, wherein the controller is configured to determine a number of operational burner elements from the at least two burner elements.

3. A modular flare stack according to claim 2, wherein the controller is configured to determine which of the at least two burner elements are to be operational.

4. A modular flare stack according to claim 1, wherein the system configured to obtain the fully premixed air-fuel mixture for the each of the at least two burner elements comprises a venturi system.

5. A modular flare stack according to claim 1, wherein the system configured to obtain the fully premixed air-fuel mixture for the each of the at least two burner elements comprises a fan system.

6. A modular flare stack according to claim 5, wherein the air-excess modulator of the each of the at least two burner elements is configured to control a speed of a fan in its respective fan system.

7. A modular flare stack according to claim 1, wherein the air-excess modulator of the each of the at least two burner elements comprises a bleed connected to its respective mixing chamber.

8. A modular flare stack for enclosed flame combustion of a combustible fluid, comprising:

a gas feed pipe; and at least two burner elements configured to combust the combustible fluid, wherein said gas feed pipe comprises a gas pressure detector configured to measure pressure of waste or process gas, wherein each of the at least two burner elements is equipped with means for obtaining a fully premixed air-fuel mixture, wherein the each of the at least two burner elements comprises:

a gas inlet, a gas permeable combustion surface, a mixing chamber, and a combustion chamber, wherein said gas inlet of the each of the at least two burner elements is adapted to receive the combustible fluid from said gas feed pipe, wherein the each of the at least two burner elements comprises a temperature detector configured to measure flue gas temperature, wherein the each of the at least two burner elements comprises an air-excess modulator for its respective mixing chamber, wherein said modular flare stack further comprises a controller configured to be responsive to said gas pressure detector, to be responsive to said temperature detectors, and to control said air-excess modulators, and wherein the each of the at least two burner elements further comprises a vertically movable insulated stack and the gas permeable combustion surface of the each of the at least two burner elements is replaceable for easy maintenance.

9. A modular flare stack according to claim 8, wherein said controller is configured to determine a number of operational burner elements from the at least two burner elements.

10. A modular flare stack according to claim 9, wherein said controller is configured to determine which of the at least two burner elements are to be operational.

11. A modular flare stack according to claim 8, wherein said means for obtaining a fully premixed air-fuel mixture for the each of the at least two burner elements comprises a venturi system.

12. A modular flare stack according to claim 11, wherein said air-excess modulator of the each of the at least two burner elements comprises a bleed connected to its respective mixing chamber.

13. A modular flare stack according to claim 8, wherein said means for obtaining a fully premixed air-fuel mixture for the each of the at least two burner elements comprises a fan system.

14. A modular flare stack according to claim 13, wherein said air-excess modulator of the each of the at least two burner elements is configured to control a speed of a fan in its respective fan system.

* * * * *